US005848638A

United States Patent [19]

Kim

[11] Patent Number: 5,848,638

[45] Date of Patent: Dec. 15, 1998

[54] FINNED TUBE HEAT EXCHANGER

[75] Inventor: Jong-Woon Kim, Incheon, Rep. of Korea

[73] Assignee: Daewoo Electronics Co., Ltd., Seoul, Rep. of Korea

[21] Appl. No.: 931,906

[22] Filed: Aug. 1, 1996

[30] Foreign Application Priority Data

Dec. 28, 1995 [KR] Rep. of Korea ..... 1995-62227

[51] Int. Cl.[6] ..... F28D 1/04

[52] U.S. Cl. ..... 165/151; 165/181

[58] Field of Search ..... 165/151, 181

[56] References Cited

U.S. PATENT DOCUMENTS

| | | | |
|---|---|---|---|
| 4,705,105 | 11/1987 | Cur | 165/151 |
| 4,723,599 | 2/1988 | Hanson | 165/151 |
| 5,042,576 | 8/1991 | Broadbent | 165/151 |
| 5,062,475 | 11/1991 | Bemisderfer et al. | 165/151 |
| 5,099,914 | 3/1992 | Reifel | 165/151 |
| 5,553,663 | 9/1996 | Yu | 165/151 |
| 5,611,395 | 3/1997 | Kang et al. | 165/151 |
| 5,722,485 | 3/1998 | Love et al. | 165/151 |

*Primary Examiner*—Ira S. Lazarus
*Assistant Examiner*—Christopher Atkinson
*Attorney, Agent, or Firm*—Beveridge, Degrandi, Weilacher & Young LLP

[57] ABSTRACT

A finned tube heat exchanger is disclosed in which the structure thereof is simple, and the heat exchanging performance is increased. The heat exchanger has a plurality of fin plates spaced at regular intervals and arranged in parallel with one another, and a plurality of heat exchanger tubes extending through the fin plates and including a refrigerant fluid therein. Each of the fin plates has a plurality of strips projected from the surface thereof, and the strips include first to fifth rows of strips arranged between openings, which are disposed adjacent to one another, in a parallel relationship. The first row of strips is located near a leading edge of the fin plates and formed of two louverlike strips in a form of a trapezoid having a long side located on the upper stream of the air flow. Each of the second to fourth rows of strips is formed of one bridgelike strip in a form of a rectangle. The fifth row of strips is formed of two louverlike strips in a form of a trapezoid having a short side located on the upper stream of the air flow.

7 Claims, 2 Drawing Sheets

FINNED TUBE HEAT EXCHANGER

BACKGROUND OF THE INVENTION

1. Field of the Invention

The present invention relates to a heat exchanger, and more particularly, to a finned tube heat exchanger for use in an air conditioner, a refrigerator or the like.

2. Description of the Prior Art

The typical air conditioning system is a combination of electromechanical elements that operate to circulate a refrigerant fluid, e.g., one of the Freon compounds, according to a refrigeration cycle. Typically, the Freon vapor is compressed by an electrically driven compressor and the compressed vapor is cooled by being passed through a heat exchanger, commonly known as a condenser. Then the Freon vapor is passed through a second heat exchanger where it picks up heat from air within the building. The refrigerant is then returned to the compressor to undergo the cycle once again.

Generally, a conventional heat exchanger is formed of a plurality of tubes made of a highly thermal conductive metal like copper and numerous thin metallic fins attached to the tubes which conduct away heat from the tubes to transfer it to air-flow directed between and over the fins. A motor driven fan generates air-flow passing through the fins surrounding the tubes. To reduce both the cost of the structure and the power requirements of the fan directing the air-flow through the heat exchanger, it is important to maximize the rate at which the refrigerant fluid flowing through the tubes transfers heat to the air flowing past the tubes and between the fins, while keeping the air flow pressure drop through the heat exchanger low.

One solution is to increase the total area of the fins by increasing the number of fins to obtain increased transfer of heat to the air flowing therebetween. This, however, diminishes the size of the passages between the fins through which the air flows and will require a more powerful fan to provide the pressure difference to force the desired amount of air flow through the fins. An alternative is to provide the fins having a wafflelike or undulation configuration to increase the area exposed to the air flow. Unfortunately, with the latter solution, a problem arises in heat transfer boundary layers which very soon diminish the amount of heat transfer that can take place between the flowing air and the fin surfaces. In recognition of this problem, designers of heat exchangers have focused on techniques to inhibit the growth of heat transfer boundary layers while increasing flow mixing and turbulence without significantly increasing the overall pressure difference required to obtain the desired flow of air through the tubes and fin assembly.

Heat transfer by conduction must first occur between the surface of the tubes and the fins, and thereafter, by convection from the fin surfaces to the air flowing between the fins. There is also a direct transfer of heat from the surface of the tubes by convection to the air flowing past the tubes, but this generally amounts to a relatively small fraction of the overall heat transfer.

FIG. 1 shows a conventional finned tube heat exchanger. As shown in FIG. 1, a heat exchanger 1 is provided with a plurality of fin plates 2 of aluminum spaced at regular intervals and a plurality of heat exchanger tubes 3 extending through fin plates 2. Heat exchanger tubes 3 are securely held in openings formed in fin plates 2 by any suitable means. Each fin plate 2 has a plurality of cut-out strips extending across the direction of air flow indicated by arrow A. These strips are for raising the heat exchanging performance and project upwardly from the surface of fin plates 2.

FIGS. 2A and 2B show the structure of a conventional fin plate. A plurality of louverlike strips 4 parallel with one another extend in a direction perpendicular to the direction of air flow indicated by an arrow A. Strips 4, as shown in FIG. 2B, are formed on the same side of each fin plate 2. In the conventional fin plate, there are problems that the manufacture is not easy and foreign materials such as dust included in the air flowing through strips 4 become easily attached to reduce the heat exchanging performance, since each strip 4 has a narrow width.

Additionally, in the case of strips 4 as shown in FIG. 2B, water drops tend to stay between adjacent strips 4, since strips 4 are spaced at narrow intervals. Thus, water drops stay on fin plates 2 until they grow into a considerable size, so that the heat exchanging performance is lowered and the corrosion of the heat exchanger is promoted.

SUMMARY OF THE INVENTION

To solve the above problems, an object of the present invention is to provide an improved finned tube heat exchanger in which the structure thereof is simple and the heat exchanging performance is raised.

To achieve the object of the present invention, there is provided a heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to the air flow; and a plurality of heat exchanger tubes extending through the openings of the fin plates in a direction perpendicular to the planes in which the fin plates lie and being adapted to allow a refrigerant fluid to pass therein.

Each of the fin plates has a plurality of strips projected from the surface of the fin plates and extends perpendicularly to a direction in which air is to flow between the fin plates.

The strips comprise first to fifth rows of strips arranged between the openings, which are disposed adjacent to one another, along the longitudinal direction of the fin plates in a parallel relationship.

The first row of strips is located near the leading edge of the fin plates and is formed of two louverlike strips in a form of a trapezoid having a long side located on the upper stream of the air flow, each of the second to fourth rows of strips is formed of one bridgelike strip in a form of a rectangle, and the fifth row of strips is formed of two louverlike strips in a form of a trapezoid having a short side located on the upper stream of the air flow.

Each of the first and fifth rows of strips has the long side cut to be projected upwardly, and each of the second to fourth rows of strips has four sides, two opposing sides, facing the air flow, being opened by cutting and the other two sides being provided with leg portions for connecting the second to fourth rows of strips with the fin plates.

The first, second, fourth and fifth rows of strips are formed on the same side of the fin plates, and the third row of strips is formed on the other side of the fin plates.

BRIEF DESCRIPTION OF THE DRAWINGS

The above object and other advantages of the present invention will become more apparent by describing in detail preferable embodiments thereof with reference to the attached drawings in which.

DETAILED DESCRIPTION OF THE PREFERRED EMBODIMENT

Hereinafter, the preferred embodiment of a finned tube heat exchanger according to the present invention will be described in detail with reference to FIGS. 3 and 4.

Similar to the conventional finned tube heat exchanger, a heat exchanger of the present invention is provided with a plurality of fin plates 10 spaced at regular intervals and a plurality of heat exchanger tubes 12 extending through fin plates 10. Heat exchanger tubes 12 are securely held in openings 14 formed in fin plates 10. Each fin plate 10 has a plurality of cut-out strips extending along a direction perpendicular to the direction of air flow indicated by arrow A. These strips are for raising the heat exchanging performance and project upwardly from the surface of fin plates 10.

Figure 1:
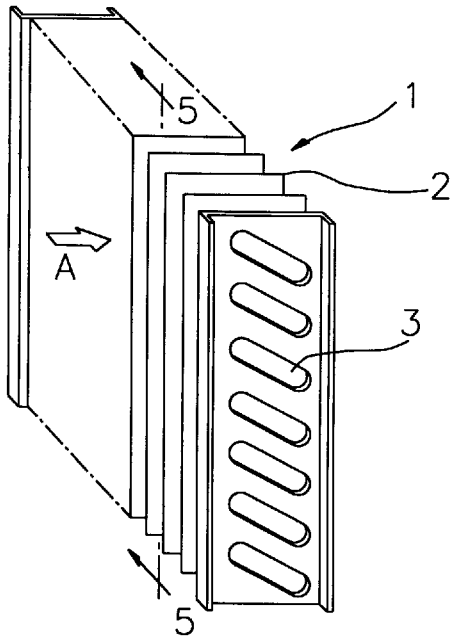
FIG. 1 PRIOR ART
FIG. 1 is a perspective view of a conventional finned tube heat exchanger.
Figure 2A:
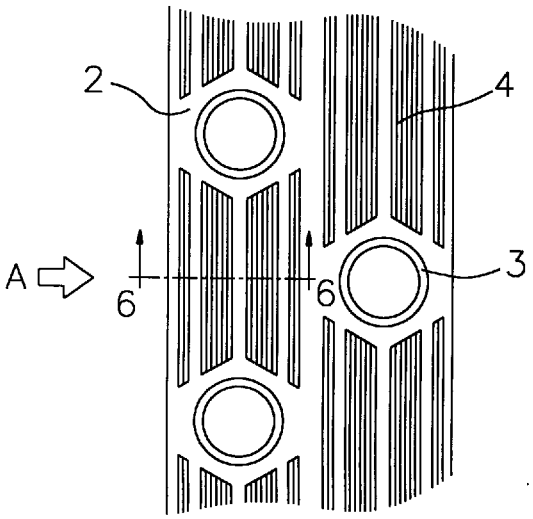
FIG. 2A PRIOR ART
FIG. 2A is a front view of a conventional finned tube heat exchanger taken along the lines 5—5 in FIG. 1.
Figure 2B:
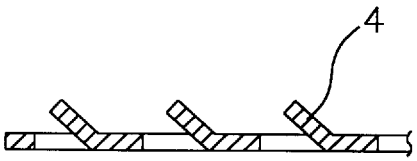
FIG. 2B PRIOR ART
FIG. 2B is an enlarged partial sectional view taken along the lines 6—6 in FIG. 2A.
Figure 3:
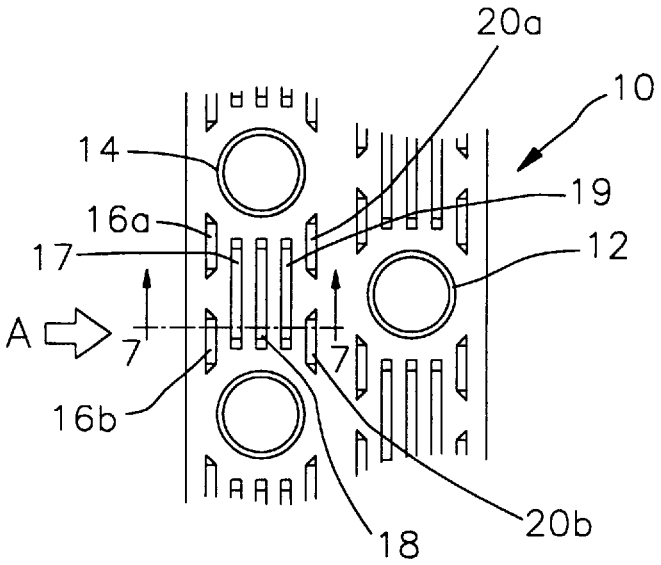
FIG. 3 is a front view of a fin plate according to the present invention.

FIG. 3 shows a fin plate 10 mounted in a finned tube heat exchanger according to the preferred embodiment of the present invention.

Fin plate 10 is made of aluminum and preferably, has a thickness of 0.12 mm. As shown in FIG. 3, strips 16*a*–16*b*, 17, 18, 19 and 20*a*–20*b* extend in a direction perpendicular to the direction of air flow indicated by arrow A and project upwardly from the surface of fin plate 10 to have a height of, preferably, 1.0 mm. Strips 16*a*–16*b*, 17, 18, 19 and 20*a*–20*b* have a width of, preferably, 1.0 mm. Strips 17 to 19 are bridgelike, and each of them has two leg portions for connecting it with fin plate 10.

The first row of strips located near a leading edge of fin plate 10 in the direction of air flow between two adjacent heat exchanger tubes 14 consists of two louverlike strips 16*a* and 16*b* in a form of a trapezoid having a long side located on the upper stream of the air flow. The long side of respective strips 16*a* and 16*b* is cut, and strips 16*a* and 16*b* bend at a predetermined angle, preferably 35°, with respect to the surface of fin plate 10.

The second row of strips consists of a bridgelike strip 17 in a form of a rectangle having four sides and projecting up. Two opposing sides, facing the air flow, are opened by cutting and the other two sides are provided with leg portions for connecting strip 17 with fin plate 10. The third and fourth rows of strips have the same shape as the second row of strips and consist of bridgelike strips 18 and 19 in a form of a rectangle having four sides and projecting up. Strip 18 is located substantially on a line between the centers of adjacent openings formed in fin plate 10.

The fifth row of strips consists of two louverlike strips 20*a* and 20*b* in a form of a trapezoid having a short side located on the upper stream of the air flow. A long side of respective strips 20*a* and 20*b* is cut, and strips 20*a* and 20*b* bend by a predetermined angle, preferably 35°, with respect to the surface of fin plate 10.

Accordingly, the first and second rows of strips are disposed in a symmetric relationship with the fourth and fifth rows of strips with respect to the center line of the third row of strips.

Figure 4:
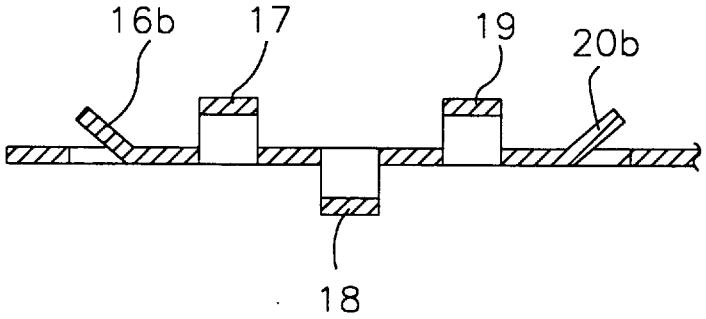
FIG. 4 is an enlarged sectional view taken along the lines 7—7 in FIG. 3.

As shown in FIG. 4, strips 16*a*–16*b*, 17, 19 and 20*a*–20*b* are formed on the same side of fin plate 10, whereas strip 18 is formed on the other side of fin plate 10.

As clearly described in the above, the effects of the heat exchanger according to the present invention are as follows:

(1) Since strips of the heat exchanger according to the present invention have a wide width and are spaced at wide intervals in comparison with those of the conventional heat exchanger, the manufacture is easy and foreign materials such as dust are less likely to become attached to maintain the constant heat exchanging performance.

(2) Since flow mixing is increased by means of projected strips, the growth of heat transfer boundary layers is inhibited to increase the heat exchanging performance. Thus, the size of the heat exchanger may be reduced.

(3) Since the interval between the strips becomes relatively wide, water drops on the fin plates drop readily. Thus, there is no case that the heat exchanging performance is lowered, and the corrosion of the heat exchanger is prevented.

While the present invention has been particularly shown and described with reference to preferred embodiment thereof, it will be understood by those skilled in the art that various changes in form and details may be effected therein without departing from the spirit and scope of the invention as defined by the appended claims.

What is claimed is:

1. A heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to the air flow; and a plurality of heat exchanger tubes extending through the openings of said fin plates in a direction perpendicular to the planes in which said fin plates lie and being adapted to allow a refrigerant fluid to pass therein, each of said fin plates having a plurality of strips projected from the surface of said fin plates and extending perpendicularly to a direction in which air is to flow between said fin plates, said strips comprising first to fifth rows of strips arranged between the openings, which are disposed adjacent to one another, along the longitudinal direction of said fin plates in a parallel relationship, said first row of strips being located near the leading edge of said fin plates and being formed of two louverlike strips in a form of a trapezoid having a long side located on the upper stream of the air flow, each of said second to fourth rows of strips being formed of one bridgelike strip in a form of a rectangle, said fifth row of strips being formed of two louverlike strips in a form of a trapezoid having a short side located on the upper stream of the air flow, each of said first and fifth rows of strips having the long side cut to be projected upwardly, each of said second to fourth rows of strips having four sides, two opposing sides, facing the air flow, being opened by cutting and the other two sides being provided with leg portions for connecting said second to fourth rows of strips with said fin plates.

2. The heat exchanger as claimed in claim 1, wherein said first to fifth rows of strips have a projecting height of about 1.0 mm.

3. The heat exchanger as claimed in claim 1, wherein said first and fifth rows of strips are slanted at an angle of about 35° with respect to said fin plates.

4. The heat exchanger as claimed in claim 1, wherein said first to fifth rows of strips have a width of about 1.0 mm.

5. The heat exchanger as claimed in claim 1, wherein said first, second, fourth and fifth rows of strips are formed on the same side of said fin plates, and said third row of strips is formed on the other side of said fin plates.

6. The heat exchanger as claimed in claim 1, wherein said third row of strips is located substantially on a line between the centers of adjacent openings formed in said fin plates, and said first and second rows of strips are disposed in a symmetric relationship with said fourth and fifth rows of strips with respect to the center line of the third row of strips.

7. A heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to the air flow; and a plurality of heat exchanger tubes extending through the openings of said fin plates in a direction perpendicular to the planes in which said fin plates lie and being adapted to allow a refrigerant fluid to pass therein, each of said fin plates having a plurality of strips projected from the surface of said fin plates and extending perpendicularly to a direction in which air is to flow between said fin plates, said strips comprising first to fifth rows of strips arranged between the openings, which are disposed adjacent to one another, along the longitudinal direction of said fin plates in a parallel relationship, said first row of strips being located near the leading edge of said fin plates and being formed of two louverlike strips in a form of a trapezoid having a long side located on the upper stream of the air flow, each of said second to fourth rows of strips being formed of one bridgelike strip in a form of a rectangle, said fifth row of strips being formed of two louverlike strips in a form of a trapezoid having a short side located on the upper stream of the air flow, each of said first and fifth rows of strips having the long side cut to be projected upwardly, each of said second to fourth rows of strips having four sides, two opposing sides, facing the air flow, being opened by cutting and the other two sides being provided with leg portions for connecting said second to fourth rows of strips with said fin plates, said first to fifth rows of strips having a projecting height of about 1.0 mm and a width of about 1.0 mm, said first and fifth rows of strips being slanted at an angle of about 35° with respect to said fin plates, said first, second, fourth and fifth rows of strips being formed on the same side of said fin plates, and said third row of strips being formed on the other side of said fin plates, said third row of strips being located substantially on a line between the centers of adjacent openings formed in said fin plates, and said first and second rows of strips being disposed in a symmetric relationship with said fourth and fifth rows of strips with respect to the center line of the third row of strips.

* * * * *